US007802317B2

(12) United States Patent
Segol

(10) Patent No.: US 7,802,317 B2
(45) Date of Patent: Sep. 28, 2010

(54) INTERCHANGEABLE HEAD COVERINGS

(76) Inventor: Avrahaum G. Segol, 588 W. End Ave., Apt. 15A, New York, NY (US) 10024

( * ) Notice: Subject to any disclaimer, the term of this patent is extended or adjusted under 35 U.S.C. 154(b) by 667 days.

(21) Appl. No.: 10/983,625

(22) Filed: Nov. 9, 2004

(65) Prior Publication Data

US 2005/0097656 A1 May 12, 2005

Related U.S. Application Data

(60) Provisional application No. 60/518,340, filed on Nov. 10, 2003.

(51) Int. Cl.
*A42B 1/04* (2006.01)

(52) U.S. Cl. ..... 2/171

(58) Field of Classification Search ..... 2/171, 2/171.1, 184, 200.1, 200.3, 204, 207, 209.3, 2/209.4

See application file for complete search history.

(56) References Cited

U.S. PATENT DOCUMENTS 1,598,379 A * 8/1926 Kerr ..... 2/171.02
2,420,378 A * 5/1947 Lehman et al. ..... 2/207
2,682,668 A * 7/1954 Hoeflich ..... 2/209.3
2,708,273 A * 5/1955 Bonaventura ..... 2/209.11
3,113,321 A * 12/1963 Siegel ..... 2/174
3,144,662 A * 8/1964 Gettinger ..... 2/204
4,091,467 A * 5/1978 Zuccaro et al. ..... 2/171
4,131,953 A * 1/1979 Kimotsuki ..... 2/171.1

* cited by examiner

*Primary Examiner*—Gary L Welch
*Assistant Examiner*—Sally C Cline

(57) ABSTRACT

The present invention provides several preferred embodiments and variations of head coverings that may be worn by both males and females, men, women, boys and girls, that come to provide alternatives to the heretofore traditional head covering worn by the general public as well as by the observance communities of the world, as well as those who prefer to cover their head as a result of sensitivity to scalp or hair due to therapeutic treatments (chemo or otherwise) sun and/or wind damage causing cosmetic concerns and or hair loss. Multiple use head coverings that also contemplate being part of or attached to other main body garments or parts there of, such as collars, blouses, jackets and the like.

9 Claims, 11 Drawing Sheets

INTERCHANGEABLE HEAD COVERINGS

This application claims priority from U.S. Provisional Patent Application 60/518,340 filed 10 Nov., 2003.

FIELD AND BACKGROUND OF THE INVENTION

The present invention relates to head coverings and, in particular, it concerns construction of decorative head coverings that may be worn by men, women, boys and girls.

It is known men women, boys and girls married or otherwise cover their head in some fashion for reason of "fashion" and/or in adherence of observant belief systems. As example, Jewish men and boys, and married women cover the head in some fashion. Observant Jewish men and boys generally wear a skullcap traditionally referred to as a kipah or yarmulke. Observant Jewish married women are know to wear a variety of head coverings such as wigs, hats, scarves, and what is traditionally referred to as a tznude, tihle, tzaif.

The present invention comes to provide alternatives to the heretofore traditional head covering worn by the general public as well as by the observance communities of the world, as well as those who prefer to cover their head as a result of sensitivity to scalp or hair due to therapeutic treatments (chemo or otherwise) sun and/or wind damage causing cosmetic concerns and or hair loss.

SUMMARY OF THE INVENTION

The present invention is decorative head covering that may be worn by either men or women.

According to the teachings of the present invention there is provided, a head covering comprising: a) a headband; and b) a headcover portion attached to the headband, wherein the attachment is such that substantially all attachment stitches are unseen from the outside of the head covering.

According to a further teaching of the present invention, the headcover portion includes a plurality of overlapping pieces that are stitched only to the headband.

According to a further teaching of the present invention, the headcover portion is vended so as to allow air circulation.

According to a further teaching of the present invention, the each of the plurality of overlapping pieces are interconnected at a substantially central point of the headcover portion.

According to a further teaching of the present invention, each of the plurality of piece is configured a substantially rectangular strip stitched to the headband at both ends of the strip.

According to a further teaching of the present invention, each of the plurality of piece is configured substantially as triangle stitched to the headband along one edge and interconnected at a corner to the others of the plurality of pieces.

According to a further teaching of the present invention, the headcover portion is configured substantially a bag-like base structure having an aperture to which the headband is stitched.

According to a further teaching of the present invention, the bag-like base structure includes wing extensions.

There is also provided according to the teachings of the present invention, a method of attaching a headband to a headcover portion of a head covering, the method comprising: a) placing a first edge of the headband material so as to abut an inside area of the headcover portion adjacent to an edge of the headcover portion; b) folding over a remaining headband material so as to abut the outside area of the headcover portion adjacent to the edge; c) stitching through all three layers consisting of the headcover portion adjacent to the edge and the headband material now abutting the inside and the outside areas of the headcover adjacent to the edge; d) folding the remaining headband material back over the stitching so as to substantially hide the stitching; e) measuring a length of the headband material to a desired length of the headband and fold the headband material inward and back toward the first edge; g) bringing a second edge of the headband material into side abutment with the first edge; and h) stitching together two layers of headband material adjacent to the first and the second edges.

There is also provided according to the teachings of the present invention, a head covering comprising: a) a headband; and b) a plurality of overlapping pieces that are stitched to the headband only, thereby forming a headcover portion.

According to a further teaching of the present invention, the headcover portion is vended so as to allow air circulation.

According to a further teaching of the present invention, the each of the plurality of overlapping pieces are interconnected at a substantially central point of the headcover portion.

According to a further teaching of the present invention, each of the plurality of piece is configured a substantially rectangular strip stitched to the headband at both ends of the strip.

According to a further teaching of the present invention, each of the plurality of piece is configured substantially as triangle stitched to the headband along one edge and interconnected at a corner to the others of the plurality of pieces.

According to a further teaching of the present invention, a portion of the headcover portion is substantially open.

According to a further teaching of the present invention, substantially all attachment stitches are unseen from the outside of the head covering.

There is also provided according to the teachings of the present invention, a head covering comprising: a) a headband; and b) a headcover portion configured substantially as a bag-like base structure having an aperture to which the headband is stitched.

According to a further teaching of the present invention, the bag-like base structure includes wing extensions.

According to a further teaching of the present invention, substantially all attachment stitches are unseen from the outside of the head covering.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is decorative head covering that may be worn by either men or women.

The principles and operation of decorative head covering according to the present invention may be better understood with reference to the drawings and the accompanying description.

By way of introduction, the present invention provides several preferred embodiments that may be worn by both men and women that come to provide alternatives to the heretofore traditional head covering worn by observant Jews.

Figure 1:
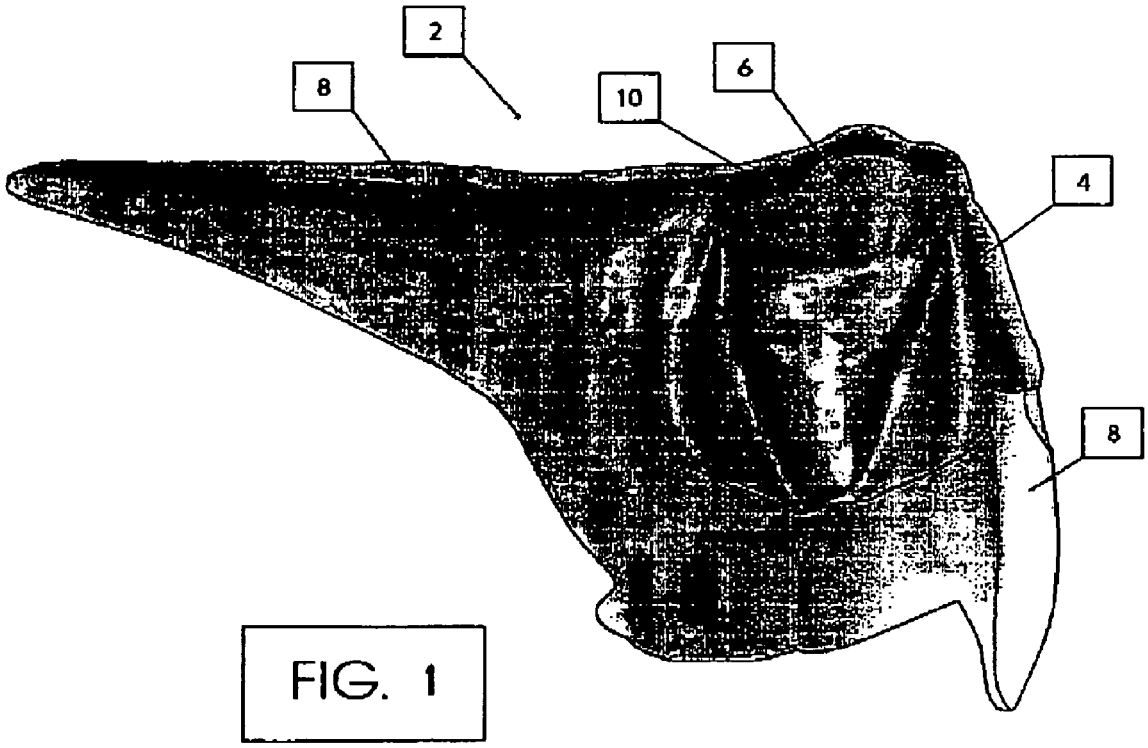
FIG. 1 shows a first preferred embodiment of a head covering constructed and operative according to the teachings of the present invention, shown in preparation for deployment on the head of a wearer.
Figure 2:
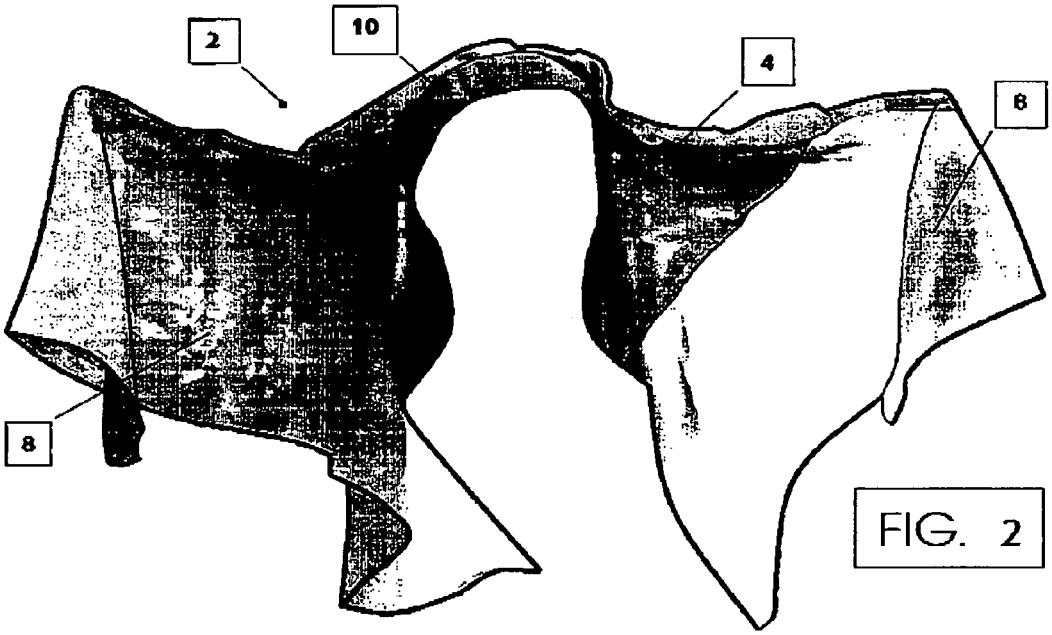
FIG. 2 shows the head covering of FIG. 1 deployed on a head, with the wings spread to illustrative purposes.
Figure 3:
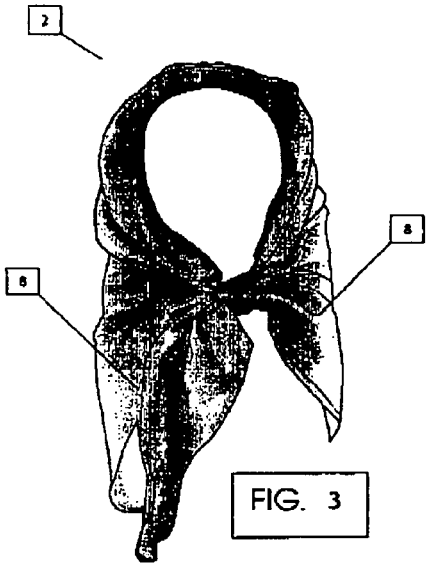
FIG. 3 shows the head covering of FIG. 1 with the wings tied under the chin of the wearer.
Figure 4:
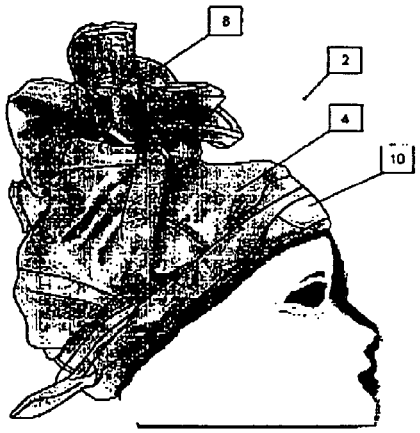
FIG. 4 shows the head covering of FIG. 1 with the wings tied up on the top of the head.
Figure 5:
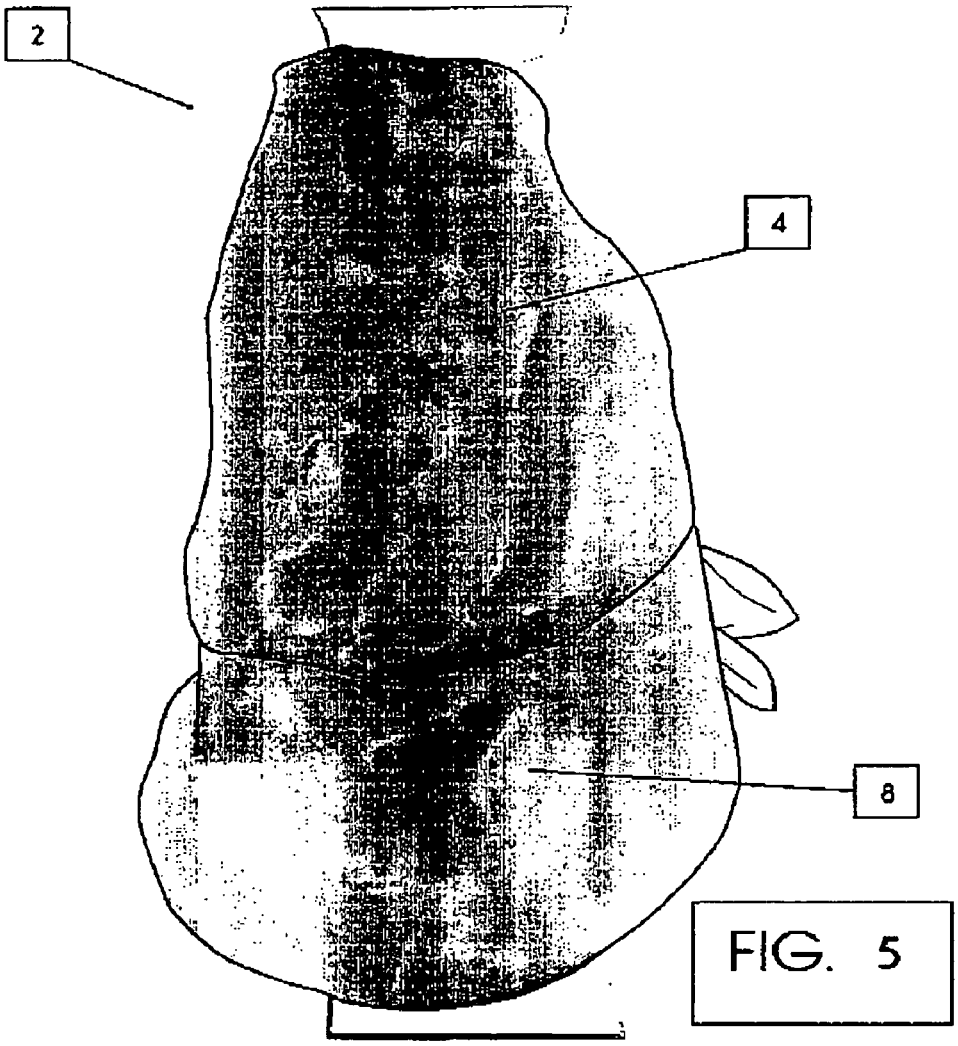
FIG. 5 shows the head covering of FIG. 1 being worn as a shawl.
Figure 6:
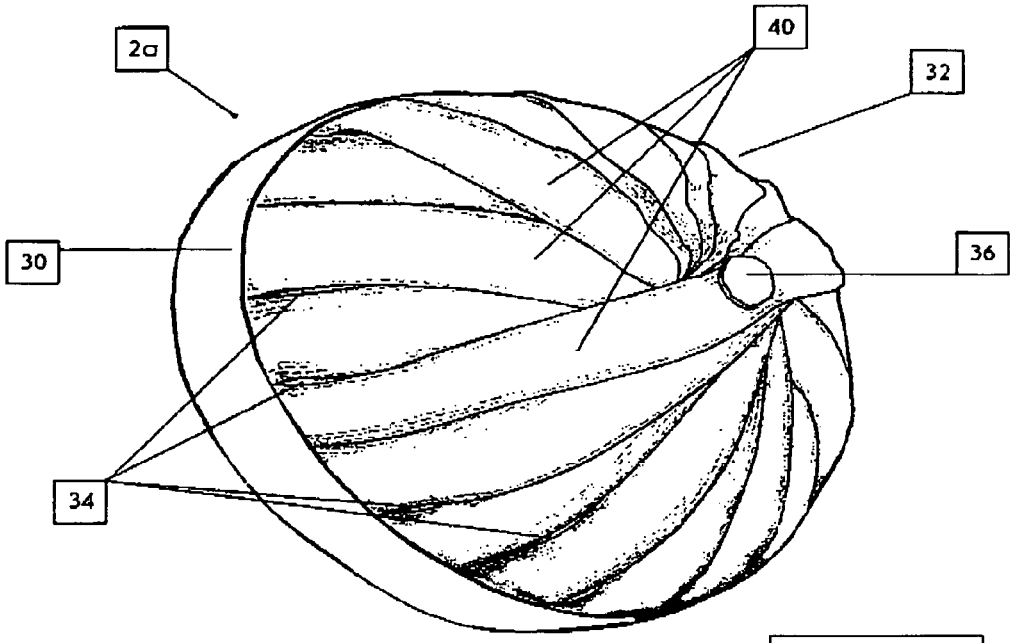
FIG. 6 shows a top perspective view of a first variation of a second embodiment of a head covering constructed and operative according to the teachings of the present invention.
Figure 7:
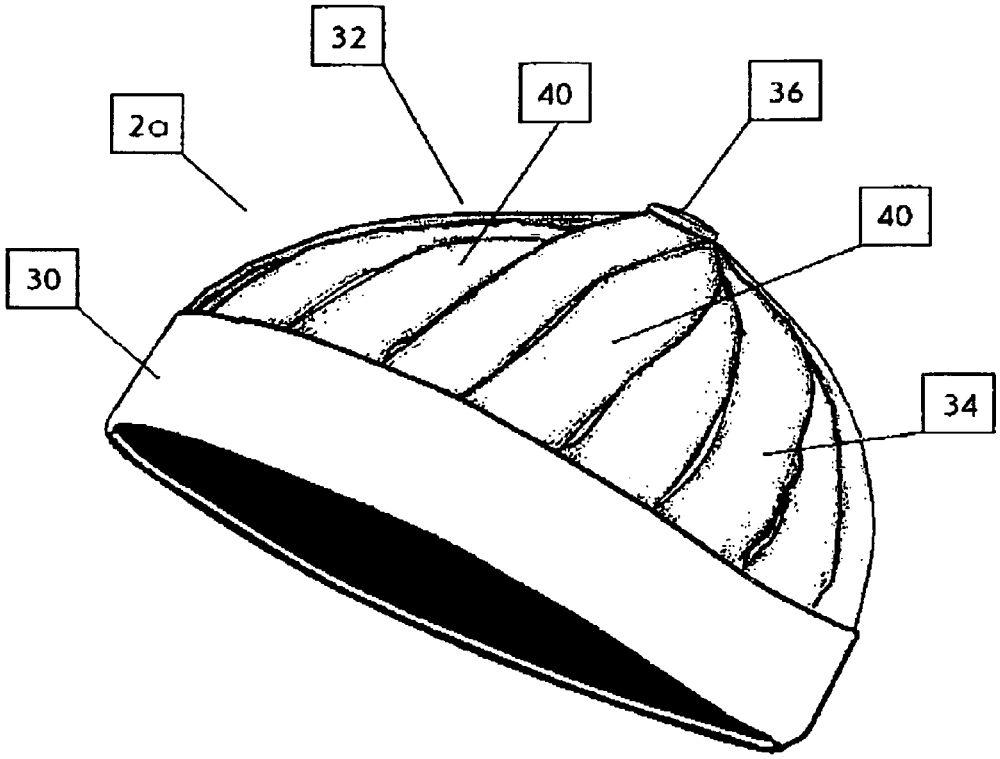
FIG. 7 shows a side view of the head covering of FIG. 6.
Figure 8:
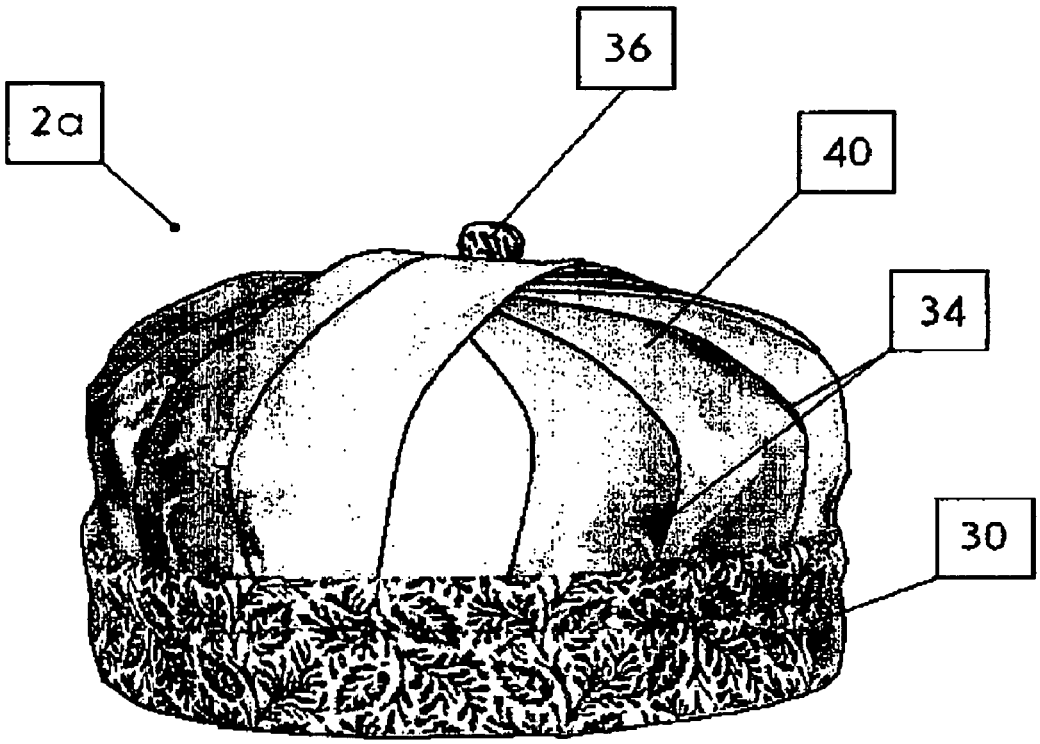
FIG. 8 shows a side view of a second variation of the second embodiment of the present invention.
Figure 9:
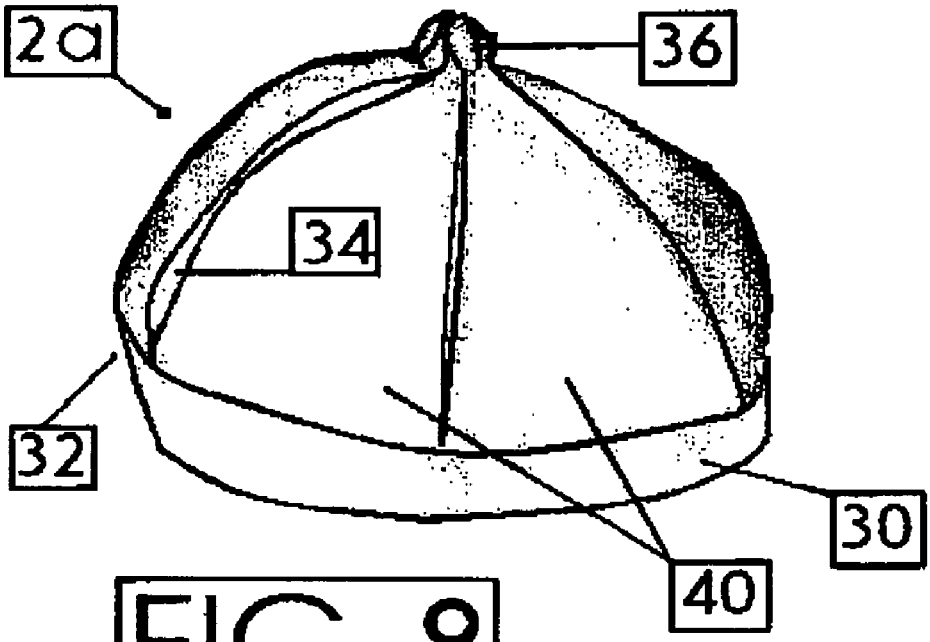
FIG. 9 shows a side view of a third variation of the second embodiment of the present invention.

Referring now to the drawings, first and second preferred embodiments, the present invention provide a head covering that may also be worn as a garment or accessory. That is, the head covering may alternately be interchanged and utilized as, for example but not limited to, a lovely head covering, and/or a shawl, a scarf, a collar, a collar/hood, halter, halter/hood, waistskirt. Alternatively, it may be a fashionable accessory item to be attached or unattached to a primary body garment such as, but not limited to, a dress, blouse, shirt, jacket, and coat, and may be used by women or men. FIGS. 1-4 illustrate a first preferred embodiment of a head covering according to the present invention, generally referred to by numeral 2, and FIG. 5 illustrates the head covering 2 of this embodiment deployed as a shawl.

Common to these head coverings is a bag-like base structure 4 having an aperture 6 located in a designated area of the bag 4. The aperture 4 is determined in direct relationship to its intended design and the wearer's head size. Such design may include, but is not limited to, head-wrap and bow, simple tie, turban (see FIG. 4), and a head cover combined with, but not limited to, a scarf (see FIG. 3), shawl, and halter. Additions to the bag-like base 4 may include, but are not limited to, attached bands, extended wings 8 having a shape such as, but not limited to, a chevron (see FIGS. 1 and 2), a butterfly, or any other attractive and desirable geometric configuration. The bag-like base 4 may be of single or double-layered construction.

A non-limiting method of constructing head covering 2 is as follows. Using one piece of material cut in an attractive chevron/triangular shape. By non-limiting example, the material may be measuring fifty-four inches in length with a mid-width measurement of twenty-four inches, which is attractively tapered off to the both ends much like a scarf may be. The edges may be finish stitch. At center-point of the length of the material, measure twelve inches outwards from both sides of center and seventeen inches deep into the mid-width measurement. Cut out the resulting semi-oval/circular shaped piece of material which may measure about twenty-four inches wide from the length of the material and seventeen inches deep into the mid-width of the material. Using that semi-oval/circular cut-out as a pattern, cut one doubled over piece of material to create a whole oval/circular shape, measuring twenty-four inches by thirty-four inches as a whole oval/circular shape, which when folded in half would be able to form-fit back into place in the previously cut-out twenty-four inch by seventeen inch vacant semi-oval/circular shape. It should be noted that this entire process of creating the oval/circular shape can be shortened into one simplified production pattern to create the two pieces described above, or an integrated single shape which can serve the same purposes, and such a process in within the scope of present invention.

Now take the doubled-over oval/circular piece and mark its center points at front and back. Measure into the body of the oval/circular material approximately three inches from the fold, at center, and make a horizontal marking parallel with the fold line measuring approximately eleven inches in length and three quarters of an inch in width extending evenly outwards from the center-point, and ending in a rounded shape at both ends. This piece is then cut out and removed from one single side of the folded material thereby creating an aperture that is used for the wearer's head as a hatband of sorts. It should be noted that the depth at which this aperture, which is aperture 6 of the finished head covering, is measured is dictated by the shape and measurements of the wearer's head and hair, as well as any choice of inserts which might be contemplated for use by the wearer for preference of shaping and/or decorative purposes.

Always keeping in mind the desired face side of the material being used to construct this item, insert the main body of material into the aperture of the oval/circular piece and line up the center-points so that the single semi-oval/circular shape of the main body material lays between the two evident semi-oval/circular shapes of the doubled-over center piece material containing the aperture. Sew a finishing stitch along the entire edge thereof and pull the main body of the material out of the resulting bag-like shape through the aperture provided. Alternatively, an exposed flat-stitch may be used to form the bag 4; thereby eliminating the step of turning the bag out, such construction may or may not include decoration over the exposed stitching. Fringes, embroidery or similar decorative or stiffening material can be stitched into the semi-oval/circular edge during this process of construction so that such embellishments or tie-on stabilizing points will be attractively apparent in its design purposes once the main body of material is revealed in the finalized form.

A headband 10 of any desired, workable width to stitch into the aperture 6, is prepared and attached using any attractive finishing stitch for attachment in accordance to preferred final design detail. The choice headband may or may not be made of an elastic material in part or whole, and which may or may not have a variety of stabilizing ties stitched into the body of the headband for purposes of securing the headband, and main body material when tied up in a turban or bow or such like design of daily usage created by the wearer, to the wearer's head, neck, shoulder, chest, and/or waist of body.

A second preferred embodiment of the head covering of the present invention, not depicted in the Figures, is similar in appearance to the first preferred embodiment, but results from a more simplified method of construction. This method, however, calls for more material usage and thus an added expense as well as a greater bulk for the end wearer. It does however, offer the end-user an option to expose their hair if so desired. One non-limiting example of constructing this second preferred embodiment may be as follows.

Using the above described method for constructing the first preferred embodiment as a reference point of understanding, cut one piece of material so as to form a quadrilateral having one diagonal length of, by non-limiting example, seventy-two inches, and a second diagonal length of, by non-limiting example, thirty-six inches between the other pair of opposing corners. A finishing edge stitch may be applied as desired at this point but is not yet required. Always keeping in mind the desired face of material to be showing fold the piece so that a triangular shape results measuring seventy-two inches from tip to tip on the fold, and eighteen inches from center point of the folded side to tip of the third point of the triangle. An aperture is cut out from one side of the material in a manner similarly described above.

Now, with face of material turned inwards run a finishing edge stitch around the three open sides of the triangle, thereby closing the piece. If it is desired that hair be exposed one would first prepare the bottom part of the triangle with a finishing edge stitch and possible closure hook, button, tie or hook and loop application to allow for such exposure. The body of the item is then pulled out through the aperture, and a headband of chosen design, as referred to above, is applied to finish the product;

In use, the wearer inserts their head into the aperture, and/or into the headband so that the wearer's facial features are displayed in a manner such that the hair of the head goes into the positioned bag-like base 4 with its wings 6 and/or extended material may be attractively shaped by letting the material drape down about the neck and/or shoulder areas. The extended material may then be tied about the head, or the head and neck areas, or the head, neck, shoulder and chest areas, in any number of designs and turban configurations, including, but not limited to attractive bow-ties, at any stylish angulation, covering head, head-hair, and/or neck, and/or shoulder, and/or chest areas of the wearer's body.

The aperture and/or headband may also be easily rearranged by the wearer in a manner so that the head covering can be converted so as to serve the function of an attractive collar, scarf, shawl, halter or waist-skirt. The aperture can be easily arranged to be collar-like or concealed, and then placed behind the neck, and/or about the shoulders and/or chest area, or at the waist-line, so that the extended wing like material can be draped on the neck, and/or shoulders, and/or chest area, or waist-line, and appropriately tied to create a collar, a scarf, a shawl, a halter, or a waist-skirt at will.

It will be appreciated that the apertures and/or headband contemplate incorporation and use of any variety of designs, purposes, and materials, including, but limited to, the use of non-stretch materials, elastic materials, fringes, visors, sun-lids, sweat-bands, tiara-like constructions, any material that is hard, soft or stiff, constructions for purposes of designing decorations and/or appliqués, and/or stiffening areas of fabric which may or may not be framing the wearer's face. Inserts for creating attractive structure formations may be contemplated to be placed into the body of this invention such as, but not limited to, at or near the location of the headband attachment, which may or may not be permanent or removable, as a temporary enhancement. It should be noted that any of the above referenced additional features may be used alone or in any combination with any one or plurality of other features.

The aperture and/or bands may be placed at specified locations on the invention so to determine any concealment or exposure of stitch-lines depending upon the desired design, and/or to determine an attractive line for attachment of fringe, or embroidery, or such decorative enhancements.

The invention described herein is intended to be a universal fashion item, flexible in its multiple uses, to serve fashion needs appropriate for all communities world-wide and the product may be designed for either women or men. It may be designed for, but not limited to, fashionable evening or day wear, be it formal or casual, in the sun or at the beach, for protection of hair and/or scalp from rays of the sun/wind/elements, to attractively conceal hair and/or scalp, on the sports field or a dance floor, during class or performances, during performance of any strenuous activity, food related or kitchen activity, hospital or technical production related work which require simple hygiene protections against hair falling down or out in the course of performance of such activities, to keep hair protected or tied back under cover, to cover-up or reduce exposure of any loss of head-hair due to chemotherapy treatments or any such medical reason, for use and sale in the open fashion and fashion accessory markets, and for use in any and all cultural settings which for reasons of various social and/or religious preference the covering of heads and/or head-hair and/or shoulders is common or desirable.

Figure 13:
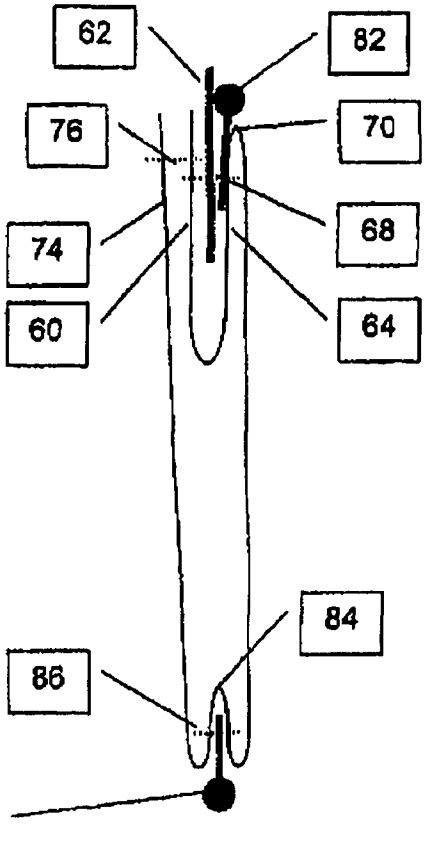
FIGS. 12-13 illustrate variations of the method of FIG. 11.
Figure 12:
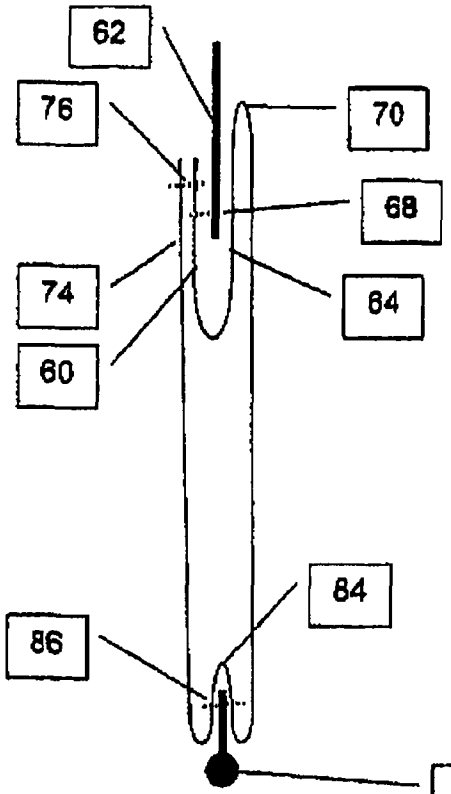

FIGS. 6-10 show variations of a third preferred embodiment of the present invention that provides a head covering configured substantially as a cap, generally referred to by the numeral 2*a*, that may include either one or both of the following features that are considered novel with regard to head coverings. The first of these features is a vented construction that readily allows for air circulation while providing for a unique and attractive appearance. The second feature is a novel method of attaching the headband to the cap portion such that no sewing stitches are visible from the outside of the cap, as illustrated in FIGS. 11-13.

Common to all of the variations of this third embodiment of the present invention is a headband 30 and a headcover portion 32. The headcover portion is generally formed by a plurality of cut pieces 40 of material that are attached to the headband and may be interconnected to one or more of the other pieces of material included in the plurality. The pieces of material may, or may not overlap. Therefore, the space 34 between the pieces of material is generally open, thereby forming vents in the headcover portion of the head covering.

A non-limiting method of constructing a head covering according to the third embodiment of the present invention may be as follows.

Use of several lengths of any chosen fabric material which are measured in proportion to the contemplated wearer's head measurements such as, but not limited to, one inch in width and ten inches in length. The lengths of material are then sewn into a headband of any chosen design so that the lengths of material are stitched side by side in an alternating manner into the headband resulting in an over-lapping of all material at the top center of the cap. The pieces may or may not be attached to a center piece, and/or center stitched at the top center of the head-cap, with or without a decorative button 36 or like devise. The pieces of material may cut into varied geometric shapes. For instance six triangular shapes can be cut and sewn into the headband so as to lay side by side, with or without some overlap to create an attractive ventilated head cap, see FIG. 9.

It will be appreciated that this embodiment may or may not have a lining.

Figure 10:
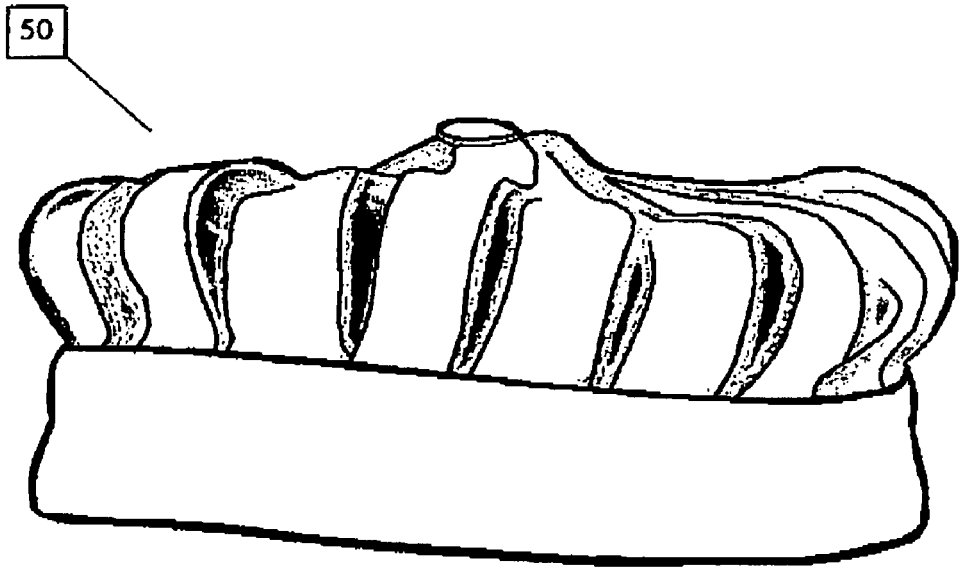
FIG. 10 shows the head covering of FIG. 8 and four other variations of the second embodiment of the present invention.
Figure 11:
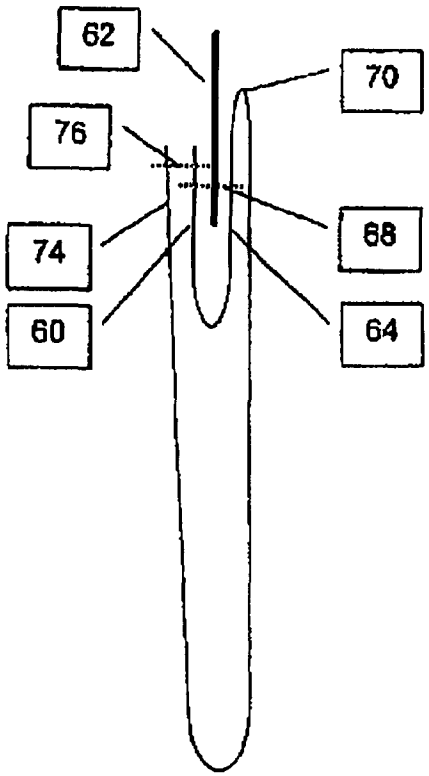
FIG. 11 illustrates a method for attaching a headband to the headcover portion of a head covering according to the teachings of the present invention.
Figure 14A:
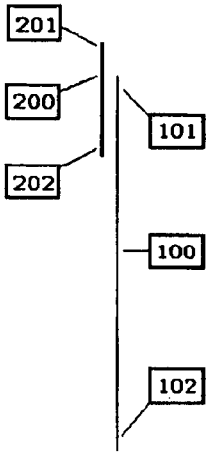
FIGS. 14*a*-14*g* illustrates the steps of attaching a headband to a head cover portion.
Figure 14B:
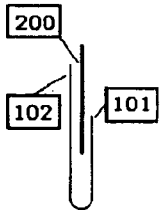
Figure 14C:
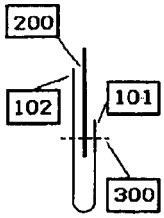
Figure 14D:
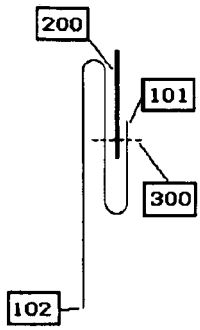
Figure 14E:
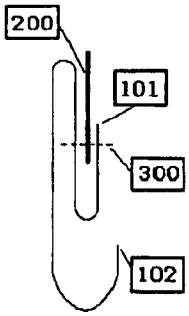
Figure 14F:
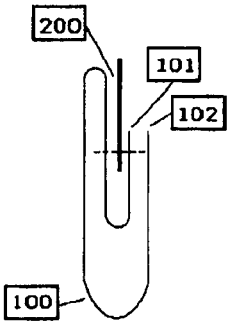
Figure 14G:
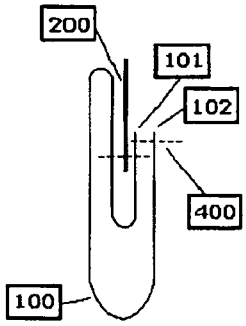

As seen in FIG. 10, the resulting "crown-like" effect of splayed sides of the head-cap is dramatic when intentionally desired to be worn in such fashion, see especially 50.

The present invention also comes to provide a unique method for attaching a headband to substantially any head covering. This method may also be applied to the construction of, but not limited to, collars, cuffs, and waistbands.

As illustrated in a most basic form in FIG. 11, the headband is formed by placing a first edge 60 of the headband material so as to abut an inside area of the headcover portion adjacent to an edge 62 of the headcover portion.

Folding over the remaining headband material such that area 64 abuts the outside area of the headcover portion adjacent to the edge 62. All three layers 60, 62 and 64 are then stitched 68 through adjacent to the edge and the headband material now abutting the inside and the outside areas of the headcover adjacent to the edge. Now fold the remaining headband material back over the stitching so as to substantially hide the stitching at fold 70. Measure a length of the headband material to a desired length of the headband and fold 72 the headband material inward and back toward the first edge 60. Bring the second edge 74 of the headband material into side abutment with the first edge 60 and stitch 76 the two layers of headband material together adjacent to the first 60 and the second 74 edges.

FIGS. 12 and 13 illustrate variations of the headband of FIG. 11, with the addition of decorative appliances 80 and 82. As is readily apparent from the drawings, decorative appliance 80 may be added by making fold 84 and stitching 86 through the headband and a portion of the decorative appliance 80 instead of making fold 72. Decorative appliance 80 may be added by inserting it between headcover portion 62 and the headband material at area 64 at the time stitch 68 is made.

FIG. 14(*a*)-14(*g*), illustrates a method of attaching a headband 100 to a headcover portion 200 of a head covering by (a) providing a headband 100 having a first end 101 and an opposite second end 102;

providing a headcover portion 200 having a first end 201 and an opposite second end 202;

abutting the first end 101 of the headband 100 to the second end 202 of the headcover portion 200 so that the first end 101 of the headband 100 overlaps the second end 202 of the headcover portion 200;

(b) folding the remaining material of the headband 100 over the second end 202 of the headcover portion 200 to create three layers of material;

(c) stitching 300 through all three layers of material;

(d) folding the remaining material of the headband 100 back towards the second end 202 of the headcover portion 200 to hide said stitching 300 while leaving an amount of material adjacent said stitch;

(e) measuring a length of said headband 100 material to a desired length and folding said measured length of headband 100 material over said three layers of material to create five layers of material;

(f) bringing the second end 102 of the headband 100 material in abutment to the first end 101 of the headband 100; and (g) stitching 400 together the first end 101 of the headband 100 material to the second end 102 of the headband material.

It will be appreciated that the above descriptions are intended only to serve as examples, and that many other embodiments are possible within the spirit and the scope of the present invention.

What is claimed is:

1. A head covering comprising:

a fabric assembly providing for an appropriately located aperture designed for the insertion of a head;

a headband comprising a first end and an opposite second end;

a headcover portion comprising a first end and an opposite second end;

said headcover being attached to said headband by only stitching the first end of said headband, the second end of said headcover and another portion of said headband distal to said first end together and additionally only stitching said second end of said headband to said first end of said headband at a location proximal to said second end of said headcover such that all the stitching is unseen from the outside of head covering.

2. The head covering of claim 1, wherein said headcover portion includes a plurality of overlapping pieces that are stitched only to said headband.

3. The head covering of claim 1, wherein said headcover portion is vented to allow for air circulation.

4. The head covering of claim 2, wherein each of said plurality of overlapping pieces are interconnected at a substantially central point of said headcover portion.

5. The head covering of claim 2, wherein each of said plurality of overlapping pieces is configured as substantially rectangular strips each strip having first and second ends wherein said ends of said rectangular strips are stitched to said headband.

6. The head covering of claim 2, wherein each of said plurality of overlapping pieces is configured substantially as a triangle and are stitched to said headband along a bottom edge of said triangle and interconnected at a top portion of said triangle to said other plurality of overlapping pieces.

7. The head covering of claim 1, wherein said headcover portion is configured substantially as a bag-like base structure having an aperture to which said headband is attached.

8. The head covering of claim 7, wherein said bag-like base structure includes a plurality of wing extensions.

9. A method of attaching a headband to a headcover portion of a head covering, the method comprising:

(a) providing a headband having a first end and an opposite second end; providing a headcover portion having a first end and an opposite second end; abutting the first end of the headband to the second end of the headcover portion so that the first end of the headband overlaps the second end of the headcover portion;

(b) folding the remaining material of the headband over the second end of the headcover portion to create three layers of material;

(c) stitching through all three layers of material;

(d) folding the remaining material of the headband back towards the second end of the headcover portion to hide said stitching while leaving an amount of material adjacent said stitch;

(e) measuring a length of said headband material to a desired length and folding said measured length of headband material over said three layers of material to create five layers of material;

(f) bringing the second end of the headband material in abutment to the first end of the headband; and (g) stitching together the first end of the headband material to the second end of the headband material.

* * * * *